US011583976B2

(12) United States Patent
Krehbiel et al.

(10) Patent No.: US 11,583,976 B2
(45) Date of Patent: Feb. 21, 2023

(54) SHOT PEEN FORMING SYSTEM

(71) Applicant: Textron Innovations, Inc., Providence, RI (US)

(72) Inventors: David Ted Krehbiel, Hesston, KS (US); Joshua Ross Huston, Douglass, KS (US); Bradley Randal Higgins, Wichita, KS (US); Aaron Paul Shirley, Wichita, KS (US)

(73) Assignee: Textron Innovations, Inc., Providence, RI (US)

( * ) Notice: Subject to any disclaimer, the term of this patent is extended or adjusted under 35 U.S.C. 154(b) by 400 days.

(21) Appl. No.: 16/058,172

(22) Filed: Aug. 8, 2018

(65) Prior Publication Data

US 2019/0047119 A1 Feb. 14, 2019

Related U.S. Application Data

(60) Provisional application No. 62/543,001, filed on Aug. 9, 2017.

(51) Int. Cl.
*B24C 1/10* (2006.01)
*B24C 3/02* (2006.01)

(52) U.S. Cl.
CPC . *B24C 1/10* (2013.01); *B24C 3/02* (2013.01)

(58) Field of Classification Search
CPC .... B24C 1/10; B24C 5/02; B24C 5/04; B24C 3/02; B24C 3/04; B24C 3/10; B24C 3/18; C21D 7/06; B21D 31/06; B21D 43/006; B21D 43/08; C22F 1/00
See application file for complete search history.

(56) References Cited

U.S. PATENT DOCUMENTS 3,423,976 A 1/1969 Burney et al.
4,423,613 A * 1/1984 DeClark ..... B24C 1/10 72/53
5,316,588 A * 5/1994 Dyla ..... B05B 13/0214 210/167.01
5,797,290 A * 8/1998 Blissell ..... B24C 1/10 29/727

(Continued)

FOREIGN PATENT DOCUMENTS

DE 4310470 C1 * 1/1994 ..... A47L 11/38

*Primary Examiner* — Adam J Eiseman
*Assistant Examiner* — Matthew Stephens
(74) *Attorney, Agent, or Firm* — Avek IP, LLC

(57) ABSTRACT

A shot-peen forming system includes a shot-sourcing chamber and a plurality of conduits, each having a first end and a second end. The first ends are coupled to the shot-sourcing chamber for receiving a portion of shot. A plurality of peen-forming jets are coupled to the second end of a respective one of the plurality of conduits. The plurality of jets are each adapted to fire shot in one of a plurality of predetermined directions to simultaneously deliver shot to a workpiece. An omnidirectional shot peening delivery system includes a plurality of nozzles positioned for shot peening from a plurality of angles, respectively. A shot distributor is adapted to receive shot through an inlet and distribute shot to the plurality of nozzles, and a workpiece holder is adapted to constrain a workpiece for receiving shot from the plurality of nozzles simultaneously to provide conformity during shot-peen forming.

20 Claims, 9 Drawing Sheets

(56) References Cited

U.S. PATENT DOCUMENTS

| | | | | |
|---|---|---|---|---|
| 6,273,154 | B1 * | 8/2001 | Laug | B05B 13/04 451/87 |
| 6,464,570 | B1 | 10/2002 | Shaw et al. | |
| 7,669,449 | B1 | 3/2010 | Sundstrom et al. | |
| 8,256,117 | B2 | 9/2012 | Hennig | |
| 9,027,375 | B2 | 5/2015 | Hennig et al. | |
| 2005/0181713 | A1 * | 8/2005 | Sekiya | B24C 3/322 451/87 |
| 2006/0101883 | A1 * | 5/2006 | Garza | B24C 1/10 72/53 |
| 2008/0223099 | A1 * | 9/2008 | David | B24C 1/10 72/53 |
| 2010/0199736 | A1 * | 8/2010 | Fujita | B24C 1/10 72/53 |
| 2011/0117823 | A1 * | 5/2011 | Lynn | B24C 9/003 451/75 |

* cited by examiner

SHOT PEEN FORMING SYSTEM

CROSS-REFERENCE TO RELATED APPLICATIONS

This application claims the benefit of U.S. Provisional Patent Application Ser. No. 62/543,001 entitled Shot Peen Forming System and filed Aug. 9, 2017, the disclosure of which is herein incorporated by reference in its entirety.

BACKGROUND

1. Field

Embodiments of this disclosure relate generally to the field of shot peen forming, and more specifically to simultaneously forming of multiple surfaces to a complex contour.

2. Description of the Related Art

Many different shot peening systems are described in the prior art. The prior art systems are typically configured for directing shot in a particular pattern or for forming a particular workpiece. For example, U.S. Pat. No. 3,423,976 to Burney et al. discloses a shot peening apparatus having a plurality of peening nozzles that move up and down in a reciprocating path, and at the same time, the plurality of nozzles are adapted to be turned back and forth through a limited arc relative to a work-piece. U.S. Pat. No. 6,464,570 to Shaw et al. discloses an omnidirectional shot nozzle that includes a flared cone-shaped deflector for radially distributing shot. U.S. Pat. No. 7,669,449 to Sundstrom et al. discloses a shot peening nozzle having a plurality of outputs that produce a spray pattern combined around a point. U.S. Pat. No. 8,256,117 to Hennig discloses a method for controlled shot-peening of blisk blades using two parallel nozzles arranged opposite one another to simultaneously drive shot onto both sides of the blades. U.S. Pat. No. 9,027,375 to Hennig et al. discloses a shot peening arrangement using a disc on a rotor to deflect shot in a circumferential direction.

SUMMARY

In an embodiment, a shot-peen forming system is provided. The system includes a shot-sourcing chamber for providing shot. The system further includes a plurality of conduits. Each of the conduits has a first end and a second end. The first ends are coupled to the shot-sourcing chamber for receiving a portion of shot. The system further includes a plurality of peen-forming jets. Each of the jets is coupled to the second end of a respective one of the plurality of conduits. The plurality of jets are each adapted to fire the portion of shot in one of a plurality of predetermined directions, respectively. A workpiece chamber for housing the plurality of peen-forming jets and for receiving a workpiece is provided such that the plurality of jets simultaneously deliver shot to the workpiece from the plurality of predetermined directions.

In another embodiment, an omnidirectional shot peening delivery system is provided. The system includes a plurality of nozzles positioned for shot peening from a plurality of angles, respectively. A shot distributor is adapted to receive shot through an inlet and distribute shot to the plurality of nozzles, and a workpiece holder is adapted to constrain a workpiece for receiving shot from the plurality of nozzles simultaneously to provide conformity during shot-peen forming.

BRIEF DESCRIPTION OF THE SEVERAL VIEWS OF THE DRAWINGS

Illustrative embodiments of the present disclosure are described in detail below with reference to the attached drawing figures, which are incorporated by reference herein and wherein.

DETAILED DESCRIPTION

Forming complex parts by shot peening presents challenges. If a part to be formed has a substantially three-dimensional structure (e.g., not flat), the process of shot peening from a single direction causes distortion, work hardening, and lack of conformity to the desired shape (e.g., unintended deformation). An example of such a part is a T-shaped stringer that is curved due to being integrated with a contoured skin for an aircraft wing.

Embodiments of the present disclosure provide a shot peening apparatus having a plurality of nozzles. The apparatus eliminates the above-mentioned problems by simultaneously shot-peen forming a plurality of sides of a part in an omnidirectional pattern. This provides conformity during forming without work hardening or unintended deformation of the part. The disclosed embodiments may be advantageously used to simultaneously form a T-shaped stringer integrated with a contoured skin (e.g., following an S-shaped curve).

Figure 1:
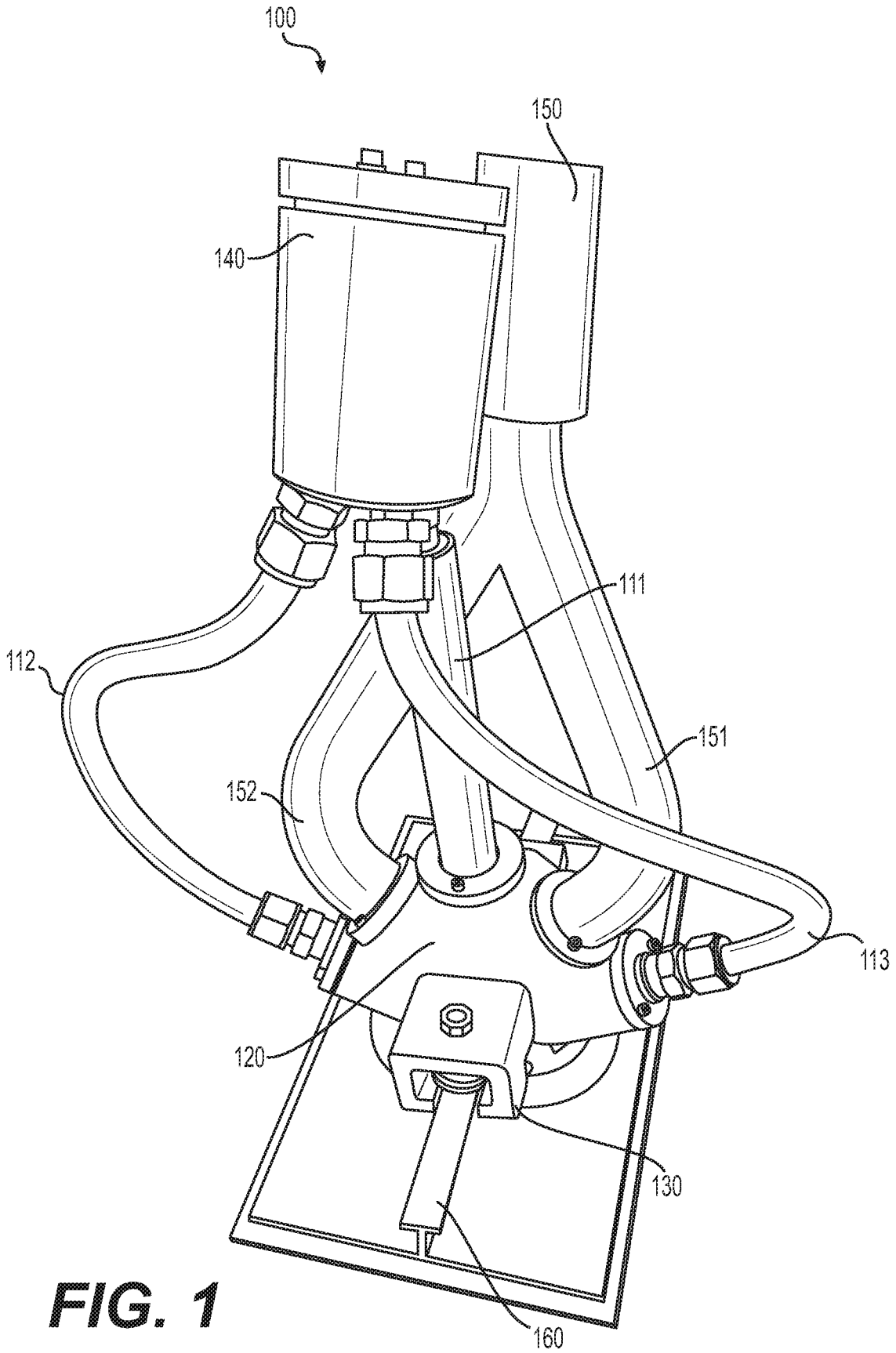
FIG. 1 is a perspective view of a shot peen forming system, in an embodiment.
Figure 2:
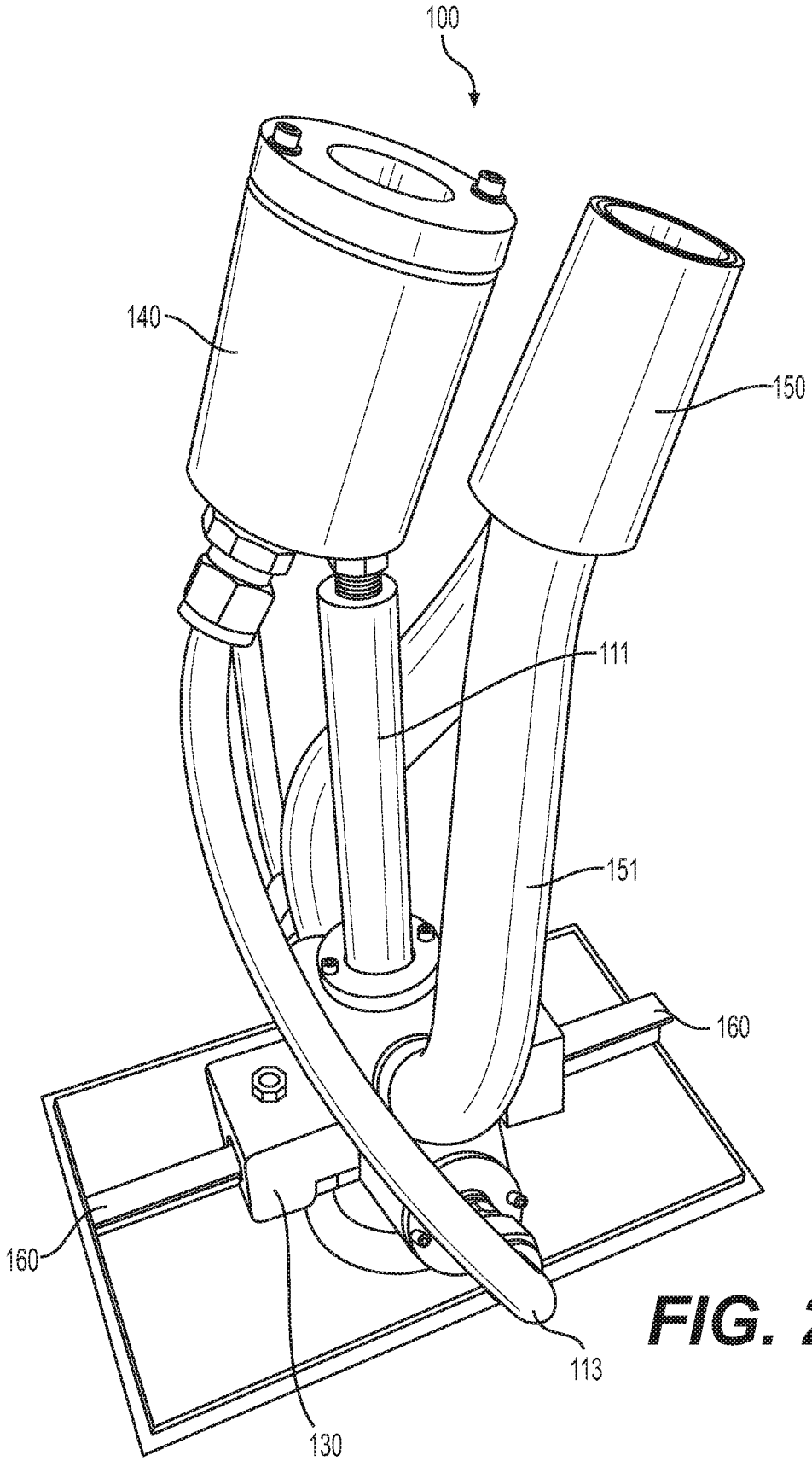
FIG. 2 is another perspective view of the shot peen forming system of FIG. 1.
Figure 3:
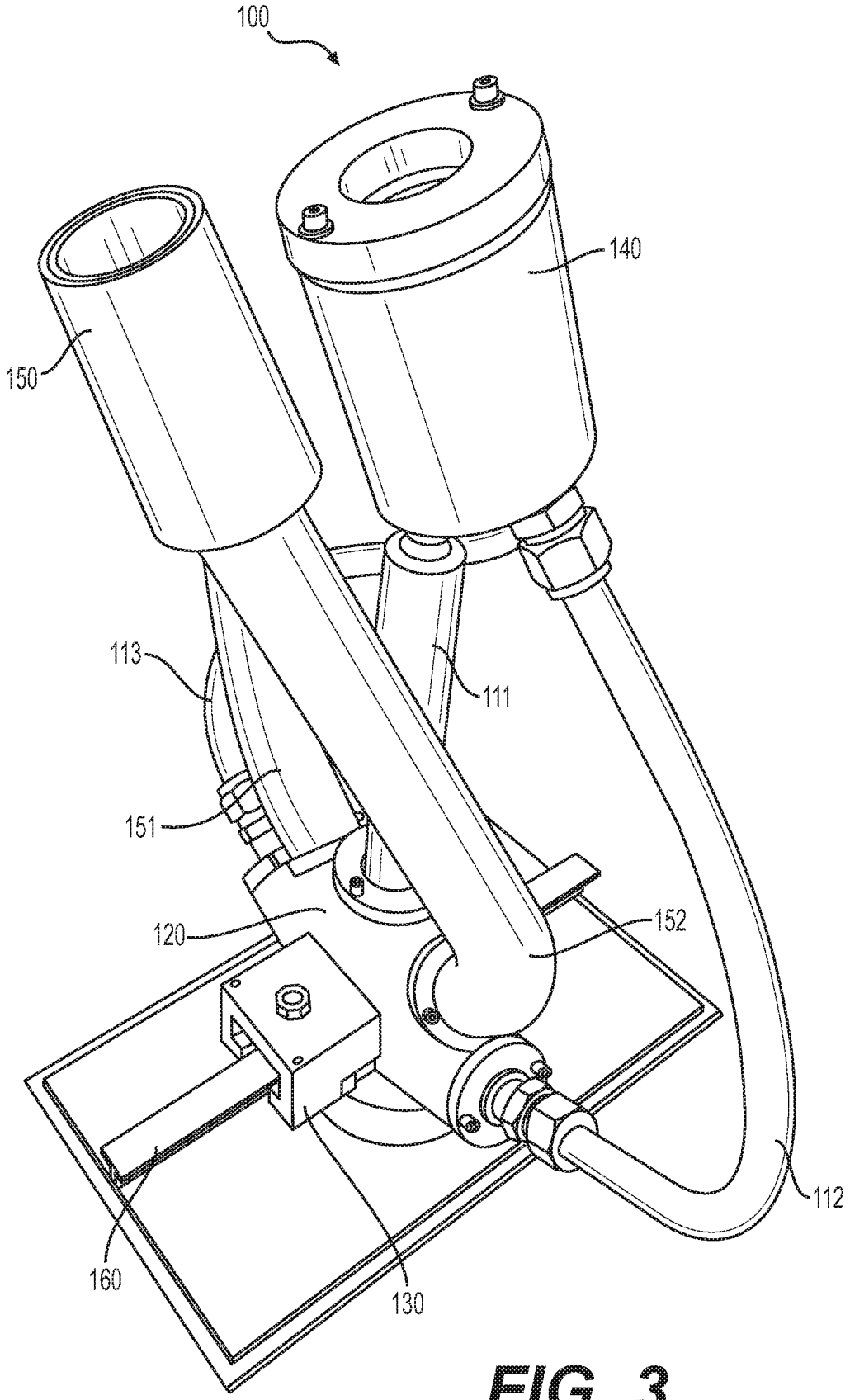
FIG. 3 is another perspective view of the shot peen forming system of FIG. 1.
Figure 7:
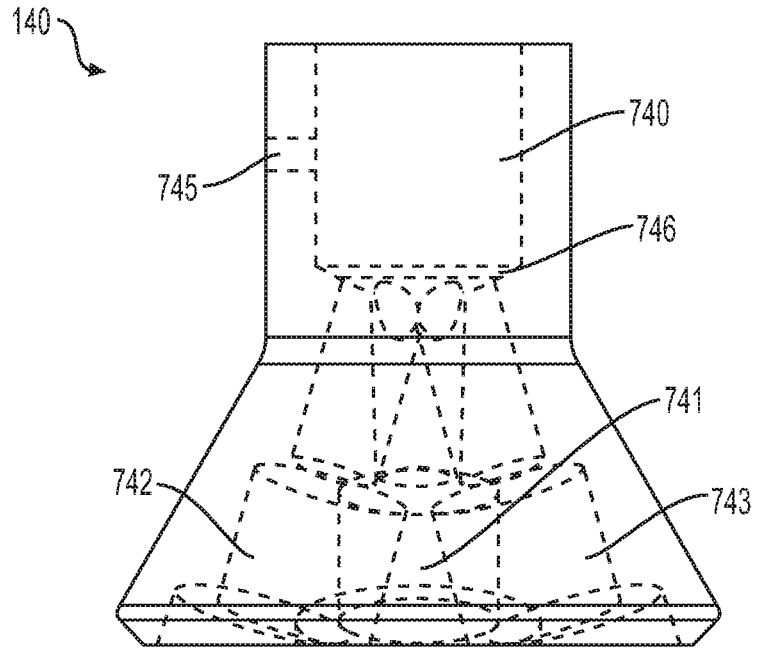
FIG. 7 shows a splitting chamber of the shot peen forming system of FIG. 4, in an embodiment.
Figure 8:
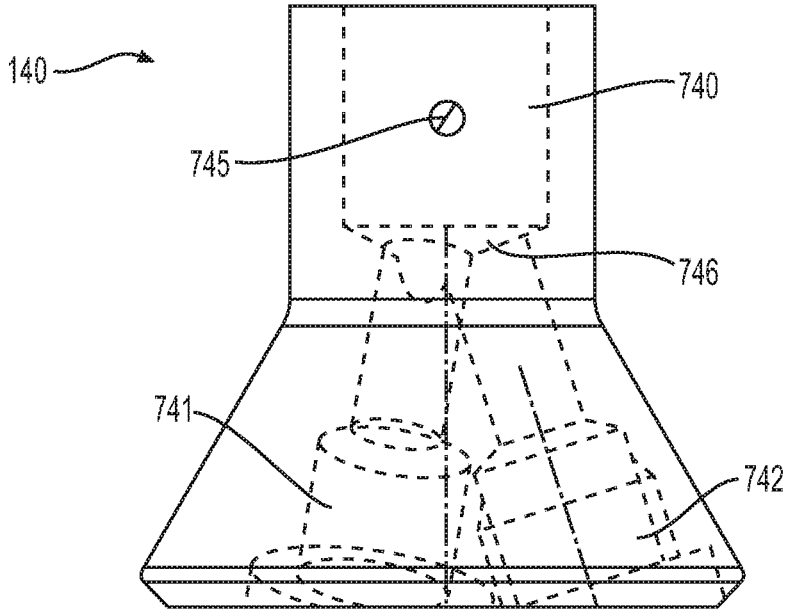
FIG. 8 shows the splitting chamber rotated from FIG. 7.

FIGS. 1-3 provide perspective views of a shot peen forming system 100. System 100 includes a shot distributor 140 that serves as a shot-sourcing chamber adapted for receiving shot with a single inlet and splitting the shot into a plurality of outlets. Shot may include pellets of steel or other suitable material. Shot may be provided to shot distributor 140 via a hose or tube from a separate device (not shown) configured to propel the shot at a predetermined velocity (e.g., a high-pressure device that pneumatically propels the shot with compressed air). Internally, shot distributor 140 may include a large-diameter bore (see e.g., FIGS. 7-9) that provides an inlet, which is adapted to receive shot from the high-pressure device. Opposite the inlet, a plurality of narrow bores form a plurality of outlets. Each of the plurality of outlets has a smaller diameter compared to the inlet, and each of the plurality of outlets is adapted to receive a portion of shot from the large-diameter bore (e.g., via a conical-shaped portion, as depicted in FIGS. 7-8). The plurality of narrow bores separates shot for delivery to a respective plurality of conduits. As depicted in FIGS. 1-3, shot distributor 140 separates shot into three tubes that serve as conduits, a first shot tube 111, a second shot tube 112, and a third shot tube 113, each adapted to direct shot to workpiece chamber 120. Shot distributor 140 may be adapted to separate shot into greater or fewer than three conduits without departing from the scope hereof.

Workpiece chamber 120 includes a shroud that forms a compartment, which may partially or fully enclose a workpiece to be formed by shot peening. In certain embodiments, the workpiece comprises a T-shaped stringer integrated with a contoured skin of an aircraft wing. As depicted in FIGS. 1-3, a workpiece 160 may include an elongated member that is longer than a diameter of workpiece chamber 120. To accommodate an elongated member of a workpiece, walls in the shroud of workpiece chamber 120 are adapted with one or more openings that enable the workpiece to extend outside of the workpiece chamber 120. For example, the workpiece chamber shroud may include one or more openings adapted for receiving an elongated workpiece, as further described below in connection with FIG. 6. In some embodiments, the elongated workpiece has an S-shaped curve along its longitudinal axis.

In operation, system 100 is adapted for moving along workpiece 160 to deliver shot along workpiece portions that extend outside workpiece chamber 120, as further described below in connection with FIG. 6. A workpiece holder 130 is configured for constraining workpiece 160 within workpiece chamber 120 as shot is delivered and while workpiece chamber 120 is moved along workpiece 160.

Workpiece chamber 120 also forms a shroud that contains spent shot after the shot is delivered to workpiece 160. An exit spout 150 is fluidly coupled with workpiece chamber 120 and to a vacuum source (not shown), such as a vacuum pump. In other words, workpiece chamber 120 serves as a vacuum shroud for containing spent shot, which is removed from workpiece chamber 120 via exit spout 150 by applying negative pressure to exit spout 150. After retrieval from workpiece chamber 120, the spent shot may be collected for subsequent reuse. In the embodiment depicted in FIGS. 1-3, a first vacuum tube 151 and a second vacuum tube 152 fluidly couple workpiece chamber 120 to exit spout 150 for transferring spent shot.

Figure 4:
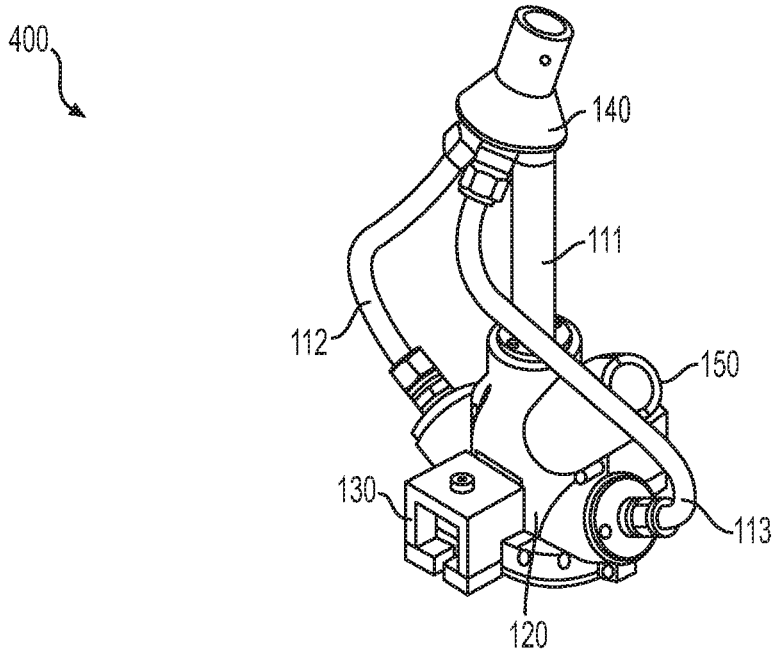
FIG. 4 is a perspective view another embodiment of a shot peen forming system.
Figure 5:
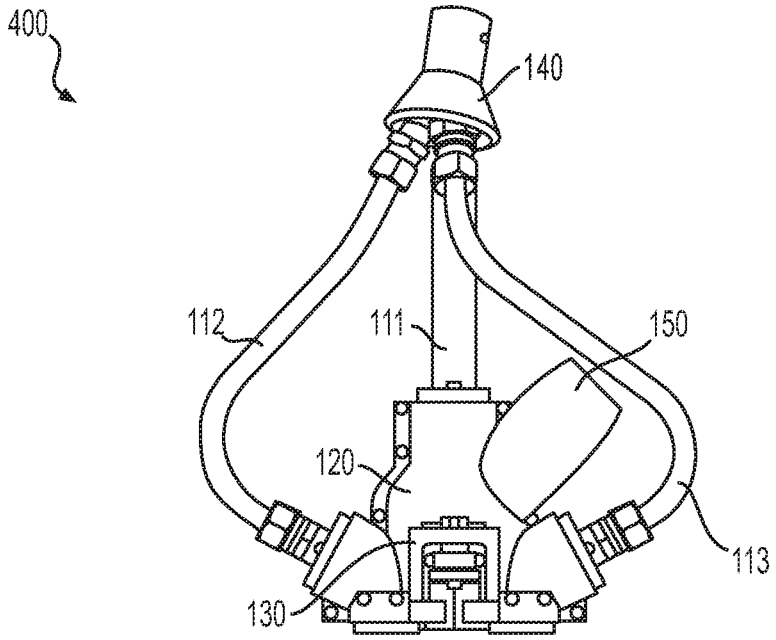
FIG. 5 is another perspective view of the shot peen forming system of FIG. 4.

FIGS. 4 and 5 provide perspective views of a shot peen forming system 400, which is an alternative embodiment of system 100, FIGS. 1-3. System 400 shares many of the same features as system 100, which are labeled with like numerals, and their description may not be repeated accordingly. As depicted in FIGS. 4 and 5, exit spout 150 couples directly to workpiece chamber 120, as opposed to system 100 in which exit spout 150 is coupled to workpiece chamber 120 via first and second vacuum tubes 151, 152 (see FIGS. 1-3).

Figure 6:
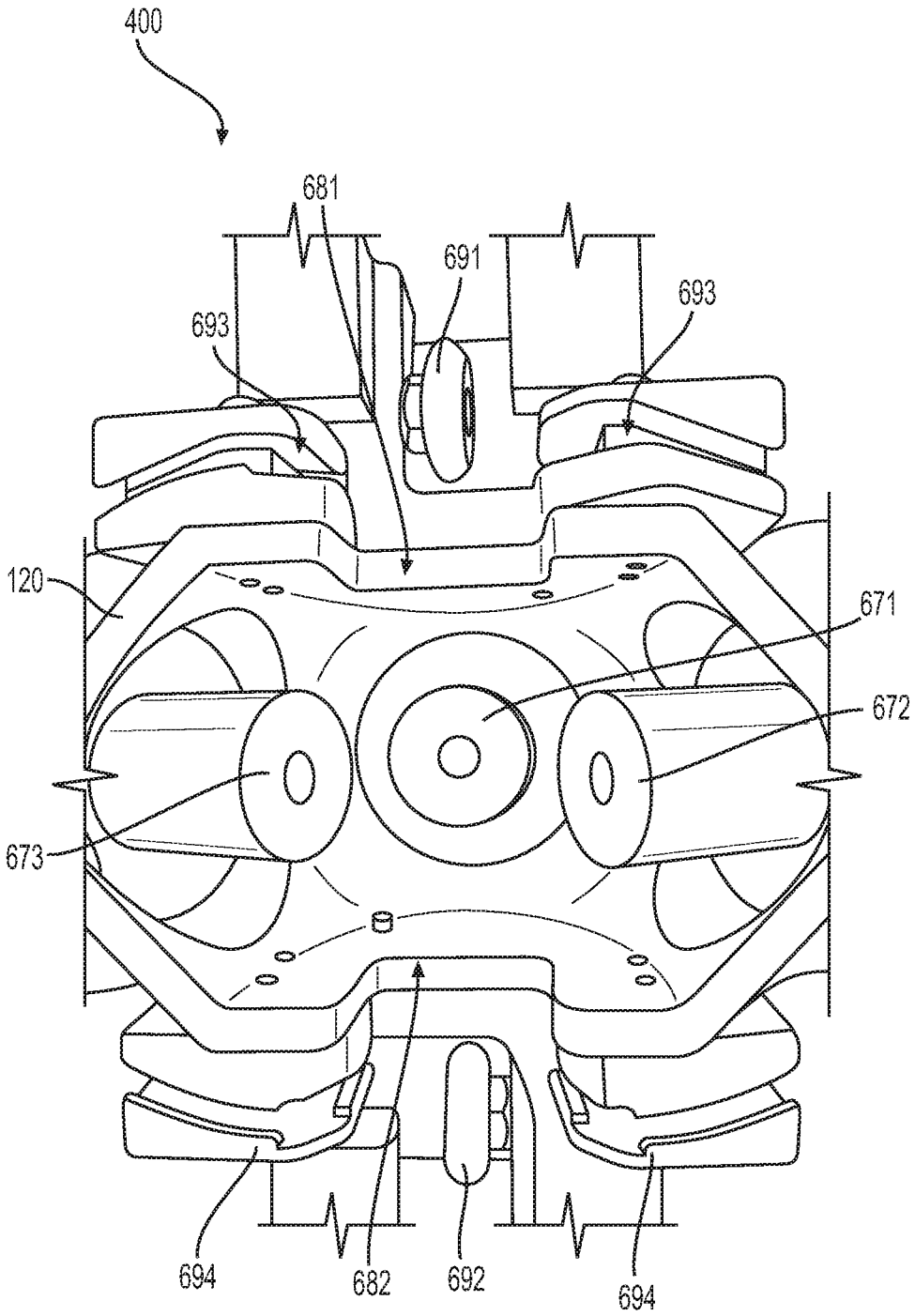
FIG. 6 is a bottom view of the shot peen forming system of FIG. 4.

FIG. 6 is a bottom view of system 400 depicting three peen-forming jets within workpiece chamber 120. A first peen-form jet 671 couples to first shot tube 111, FIG. 1, a second peen-form jet 672 couples to second shot tube 112, FIG. 1, and a third peen-form jet 673 couples to third shot tube 113, FIG. 1. First, second, and third peen-forming jets 671-673 are, for example, nozzles for firing shot. Workpiece chamber 120 provides a shroud that envelopes first, second, and third peen-forming jets 671, 672, 673 from above for containing shot as the jets fire the shot and it ricochets off workpiece 160.

The peen-forming jets 671-673 are positioned for simultaneously delivering shot from a plurality of fixed predetermined directions. In certain embodiments, peen-forming jets 671-673 are fixed in position for simultaneously firing shot at a first side of workpiece 160, a second side opposite the first side, and a third side that is different than either of the first side or the second side (e.g., between the first side and the second side). In some embodiments, peen-forming jets 671-673 are positioned for firing at a fixed predetermined angle towards workpiece 160. For example, first jet 671 is positioned directly above workpiece 160 (e.g., at an angle of zero degrees), second jet 672 is offset to one side of first jet 671 by an angle of about thirty degrees to about sixty degrees, and third jet 673 is offset to an opposite side of second jet 672 by an angle of about thirty degrees to about sixty degrees.

In certain embodiments, workpiece 160 is a T-shaped stringer having a top and two opposing sides. First jet 671 is positioned for firing on a top of the T-shaped stringer, while second and third jets 672, 673 are positioned for firing on opposite sides of the T-shaped stringer. For example, shot strikes the top and two opposing sides of the T-shaped stringer at angles that provide maximum forming force without work hardening. Jets 671, 672, and 673 may be alternatively configured for simultaneously firing on workpieces having a variety of shapes, without departing from the scope hereof.

A first opening 681 and a second opening 682 formed in workpiece chamber 120 and aligned longitudinally with respect to one another for receiving workpiece 160, as depicted in FIG. 6. Workpiece 160 may protrude through one or both of first opening 681 and second opening 682 during forming. A first wheel 691 and a second wheel 692 are aligned longitudinally with first and second openings 681, 682 and with respect to one another. First and second wheels 691, 692 are configured to interface with a first side (e.g., a top side) of workpiece 160 for rolling along the workpiece in a longitudinal direction.

In operation, when a worker or automated system moves workpiece 160 longitudinally, the workpiece may be treated by peen forming in a longitudinal direction at a predetermined rate. In certain embodiments, first and second openings 681, 682 serve as guides to provide alignment between workpiece chamber 120 and workpiece 160. For example, during movement of system 400 longitudinally along workpiece 160, first and second openings 681, 682 assist with guiding system 400 to maintain proper alignment of workpiece chamber 120 along workpiece 160. In some embodiments, dedicated components are provided within or adjacent first and second openings 681, 682 to serve as guides for workpiece 160 (see e.g., FIG. 10).

In certain embodiments, workpiece chamber 120 is adapted with a brush adjacent each of first and second openings 681, 682. Each brush is configured for containing spent shot to within workpiece chamber 120 as system 100 is moved along workpiece 160. Specifically, the shot containment brushes include bristles that part around workpiece 160 as system 100 is rolled via first and second wheels 691, 692. As depicted in FIG. 6, a first pair of opposing slots 693 are aligned with one another adjacent first opening 681, and a second pair of opposing slots 694 are aligned with one another adjacent second opening 682. First and second pair of opposing slots 693, 694 are each configured for securing a shot containment brush (not shown).

Figure 9:
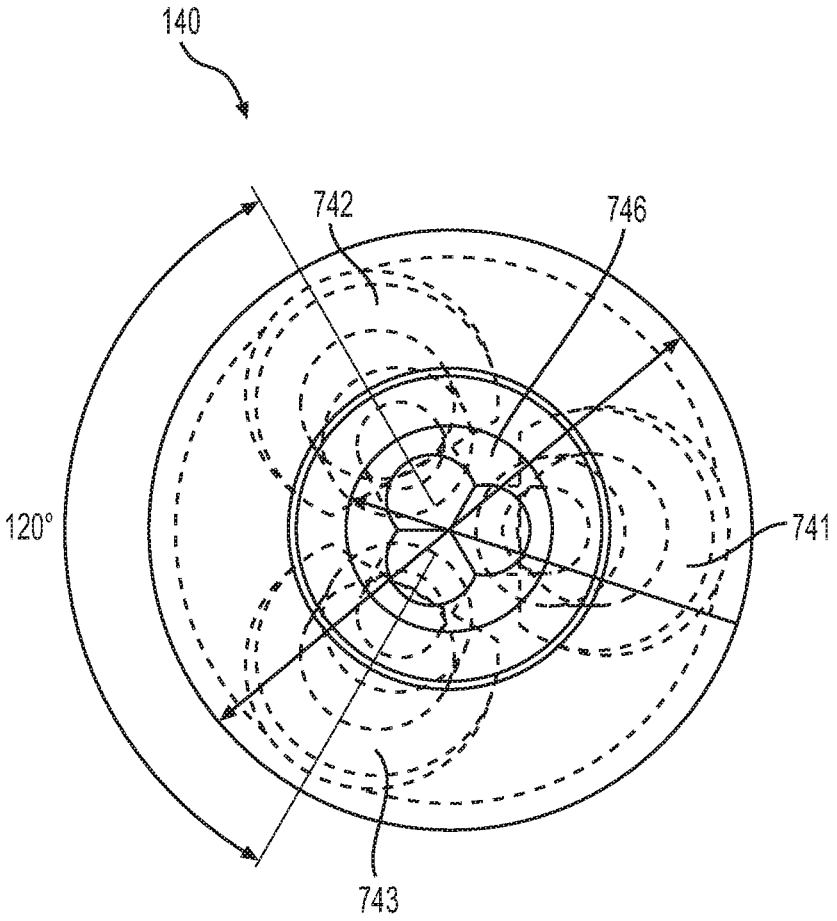
FIG. 9 shows a top-down view of the splitting chamber of FIG. 7.

FIGS. 7, 8 and 9 show shot distributor 140 with dashed lines depicting internal channels. FIGS. 7 and 8 provide side views of shot distributor 140 from perpendicular perspectives. In other words, FIG. 8 shows shot distributor 140 rotated about ninety degrees compared to the orientation depicted in FIG. 7. A top-down view of shot distributor 140 is provided in FIG. 9 with dashed lines depicting internal channels. The internal channels include an input channel 740 and a first output channel 741, a second output channel 742, and a third output channel 743. Shot distributor 140 accepts shot via a hose or tube inserted into input channel 740. A set screw may be placed in a threaded channel 745 for securing the hose or tube within input channel 740.

Shot distributor 140 distributes shot to first, second, and third output channels 741, 742, 743, which couple to first, second, and third shot tubes 111, 112, 113, respectively (see e.g., FIGS. 4 and 5). Each of first, second and third shot tubes 111, 112, 113 has a first end and a second end, with the first end coupled to a respective one of the output channels 741, 742, 743, and the second end coupled to a respective one of the first, second, and third peen-forming jets 671, 672, 673. The first end of each of shot tubes 111, 112, 113 is configured for receiving a respective distributed portion of the shot. The peen-forming jets 671, 672, 673 are configured to deliver the respective distributed portion of shot to workpiece 160.

A conical portion 746 couples input channel 740 with output channels 741, 742, 743 and funnels shot from input channel 740 to output channels 741, 742, 743. In certain embodiments, output channels 741, 742, 743 are equally sized and equally spaced (e.g., oriented with about one-hundred-twenty degrees rotation with respect to one another) such that shot is equally distributed among output channels 741, 742, 743.

Figure 10:
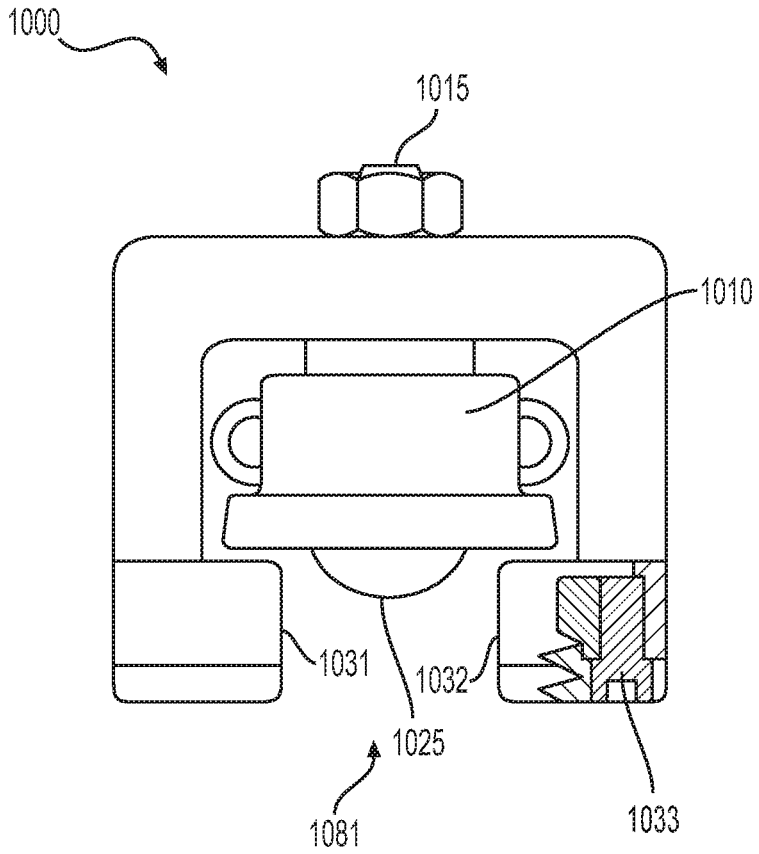
FIG. 10 shows a workpiece holder of FIGS. 1-5 in further exemplary detail.

FIG. 10 depicts workpiece holder 1000, which is an alternative embodiment to workpiece holder 130, FIG. 1 having a ball transfer 1010 in place of wheel 691. Ball transfer 1010 secures a ball 1025 for gliding along a top of the workpiece. A stud 1015 is used to mount ball transfer 1010 to workpiece holder 1000. Stud 1015 is for example a threaded bolt held in place by a nut. A gap 1081 is configured for accepting the workpiece and aligning with first opening 681, FIG. 6. A first guide 1031 and a second guide 1032 are positioned on opposing sides of gap 1081 for aligning the workpiece therebetween. In certain embodiments, first guide 1031 and/or second guide 1032 are adjustable for accommodating differently sized workpieces. For example, second guide 1032 may be replaced with a larger or smaller guide for adjusting the size of gap 1081 via a bolt 1033, as depicted in FIG. 10.

Figure 11:
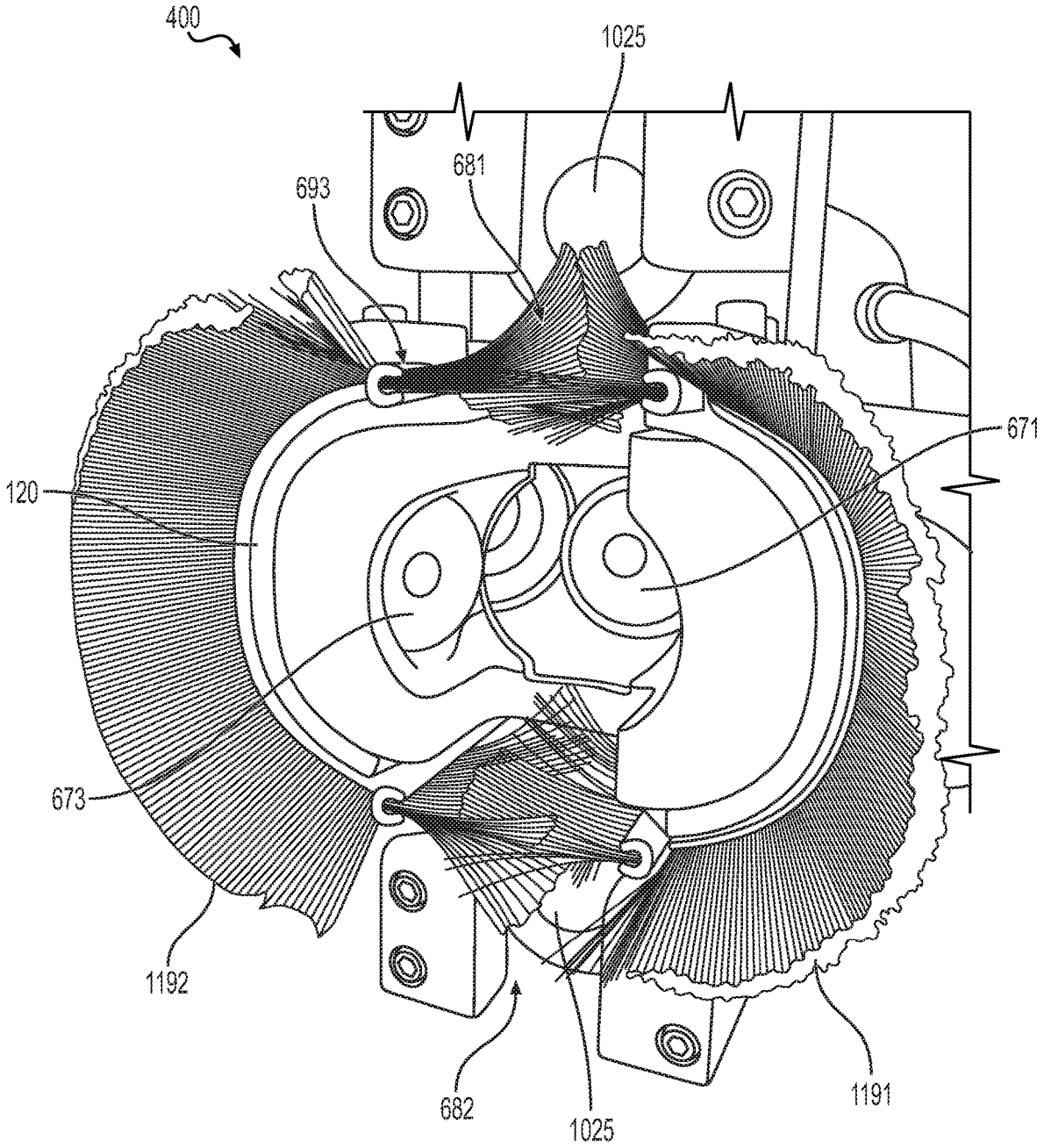
FIG. 11 is a bottom view of the shot peen forming system showing brushes, in an embodiment.

FIG. 11 is a bottom view of the shot peen forming system 400 showing a first brush 1191 and a second brush 1192. The first and second brushes 1191, 1192 are configured for containing spent shot to within workpiece chamber 120. As system 400 is moved along a workpiece, bristles of first and second brushes 1191, 1192 part around the workpiece. In the embodiment of FIG. 11, ball 1025, which is described above in connection with FIG. 10, is located outside each of first opening 681 and second opening 682 for gliding along a top of the workpiece as system 400 is moved longitudinally along the workpiece.

In operation, system 400 is placed on the workpiece to be peen formed and attached to the peen forming equipment, which propels the shot at the workpiece and retrieves the spent shot for reuse. An operator uses a trigger mechanism supplied by a separate peen forming device (not shown) to regulate the flow of shot delivered to system 400 (e.g., via input channel 740). Meanwhile, the operator or a robot is used to roll (e.g., using one or more wheels or ball transfers) system 400 longitudinally along workpiece 160. Workpiece holder 1000 may be guided along workpiece 160 via a first guide 1031 and a second guide 1032, for example. The shot is separated by shot distributor 140 into first, second, and third shot tubes 111, 112, 113 and expelled from first, second, and third peen-forming jets 671, 672, 673 at predetermined angles for simultaneously striking the workpiece. In doing so, the workpiece is uniformly shaped. The workpiece chamber 120 contains the spent shot for vacuum retrieval via exit spout 150 for subsequent reuse.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure.

It will be understood that certain features and sub-combinations are of utility and may be employed without reference to other features and sub-combinations and are contemplated within the scope of the claims. Not all steps listed in the various figures need be carried out in the specific order described.

What is claimed is:

1. A shot-peen forming system, comprising:

a shot-sourcing chamber having an input channel and a plurality of output channels configured for equally distributing shot;

a plurality of conduits, each of the conduits having a first end and a second end, the first ends being coupled to the shot-sourcing chamber for receiving an equal portion of shot;

a plurality of peen-forming jets, each of the jets being coupled to the second end of a respective one of the plurality of conduits, wherein the plurality of jets are each fixed in position to simultaneously fire the equal portion of shot in one of a plurality of fixed predetermined directions, respectively; and a workpiece chamber for housing the plurality of peen-forming jets, the workpiece chamber comprising:

a first opening in a wall of the workpiece chamber configured for receiving a workpiece;

a second opening in the wall of the workpiece chamber, opposite the first opening, the second opening being configured for the workpiece to extend out of the workpiece chamber through the second opening; and a workpiece holder configured to guide the workpiece, wherein the workpiece comprises a T-shaped cross-section, the workpiece holder comprising:

a first guide and a second guide forming a gap therebetween, wherein the gap is aligned with the first opening and configured to receive the workpiece; and a ball transfer having a ball configured for gliding along a top of the workpiece, wherein said ball transfer is positioned within said first opening;

wherein the first guide, the second guide, and the ball transfer are configured for aligning the workpiece through the first opening.

2. The shot-peen forming system of claim 1, wherein the workpiece chamber comprises an exit spout fluidly coupled with a vacuum subsystem for pneumatically removing spent shot from the workpiece chamber.

3. The shot-peen forming system of claim 1, wherein the workpiece chamber comprises a first vacuum tube and a second vacuum tube each fluidly coupled with the workpiece chamber and an exit spout, the exit spout being fluidly coupled with the vacuum subsystem for removing spent shot from the workpiece chamber.

4. The shot-peen forming system of claim 1, further comprising a wheel located proximate to the second opening, wherein the wheel is aligned with the second opening such that wheel is rollable along a portion of the elongated member thereby facilitating movement of the workpiece chamber with respect to the elongated member for delivering shot along the elongated member.

5. The shot-peen forming system of claim 1, further comprising a first brush adjacent the first opening and a second brush adjacent the second opening, the first brush and the second brush being adapted for containment of shot within the workpiece chamber.

6. The shot-peen forming system of claim 1, wherein the plurality of jets comprises:

a first jet positioned for firing shot onto a first side of the workpiece;

a second jet positioned for firing shot at a second side of the workpiece, opposite the first side;

a third jet positioned for firing shot at a third side of the workpiece, the third side being on a top portion of the workpiece; and a fixed orientation of the first jet, the second jet, and the third jet, such that shot simultaneously strikes the first side, the second side, and the third side of the workpiece with equal amounts of shot at predetermined angles configured to increase forming force and provide conformity without causing work hardening and unintended deformation of the workpiece.

7. The shot-peen forming system of claim 6, wherein the first jet, the second jet, and the third jet are adapted for providing an omnidirectional pattern of shot fired simultaneously at the workpiece.

8. The shot-peen forming system of claim 1, wherein the workpiece chamber is adapted for shot-peen forming a curved workpiece that comprises a T-shaped stringer having an elongated member integrated with a contoured skin of an aircraft wing such that the elongated member has an S-shaped curve along its longitudinal axis.

9. The shot-peen forming system of claim 1, wherein the ball transfer is mounted to the workpiece holder via a threaded bolt and nut, wherein the threaded bolt is adjustable for adjusting a height of the ball transfer to accept workpieces of varying heights.

10. An omnidirectional shot peening delivery system, comprising:

a plurality of nozzles fixed in a respective plurality of orientations for simultaneously shot peening a T-shaped workpiece on a first side, a second side opposite the first side, and a third top side perpendicular to the first side and the second side of the T-shaped workpiece;

a shot distributor adapted to receive shot through an inlet and evenly distribute shot to the plurality of nozzles;

a workpiece chamber having a shroud that envelopes the plurality of nozzles;

a first opening in the shroud of the workpiece chamber;

a second opening in the shroud, opposite the first opening, such that the workpiece chamber may be moved along an elongated workpiece that extends out of the shroud through the first opening and the second opening; and a workpiece holder adapted to maintain a predetermined orientation between the workpiece and the plurality of nozzles to provide conformity during shot-peen forming, the workpiece holder comprising:

a ball transfer having a ball configured for gliding along the third top side of the T-shaped workpiece;

a first guide aligned with the first side of the T-shaped workpiece and a second guide aligned with the second side of the T-shaped workpiece; and a gap formed between the first guide and the second guide, wherein the gap is aligned with the first opening, and the first guide and the second guide are configured for aligning the T-shaped workpiece through the first opening.

11. The omnidirectional shot peening delivery system of claim 10, further comprising a first brush adjacent the first opening for containing spent shot and a second brush adjacent the second opening for containing spent shot, wherein the elongated workpiece may pass through the first brush and the second brush during movement of the workpiece chamber.

12. The omnidirectional shot peening delivery system of claim 10, further comprising at least one wheel adapted for rolling along a workpiece to facilitate movement of the workpiece chamber with respect to the workpiece.

13. The omnidirectional shot peening delivery system of claim 10, further comprising at least one ball transfer that secures a ball for gliding along a portion of the workpiece to facilitate movement of the workpiece chamber with respect to the workpiece.

14. The omnidirectional shot peening delivery system of claim 10, wherein the workpiece holder may be guided along the workpiece via a first guide aligned with a first side of the workpiece and a second guide aligned with a second side of the workpiece, substantially opposite the first side.

15. The omnidirectional shot peening delivery system of claim 10, wherein the plurality of nozzles comprises:

a first nozzle oriented in a first fixed position for shot peening a first side the workpiece;

a second nozzle oriented in a second fixed position for shot peening a second side the workpiece, substantially opposite the first side; and a third nozzle oriented in a third fixed position for shot peening a third side of the workpiece, different from the first side and the second side, such that shot peen forming occurs simultaneously in an omnidirectional pattern along the first side, the second side, and the third side of the workpiece.

16. The omnidirectional shot peening delivery system of claim 10, wherein the workpiece chamber comprises an exit spout fluidly coupled with a vacuum subsystem for removing spent shot from the workpiece chamber via negative pressure.

17. The omnidirectional shot peening delivery system of claim 10, wherein the workpiece chamber is adapted for shot-peen forming a workpiece that comprises a T-shaped stringer integrated with a contoured skin of an aircraft wing.

18. The omnidirectional shot peening delivery system of claim 10, wherein the workpiece chamber is adapted for shot-peen forming an elongated workpiece that has an S-shaped curve along its longitudinal axis.

19. An omnidirectional shot peening delivery system, comprising:

a plurality of nozzles oriented in a plurality of fixed positions, respectively, for shot peening a portion of an elongated curved workpiece, the shot being delivered to a plurality of sides of the portion simultaneously;

a shot distributor adapted to receive shot through an inlet and equally distribute shot to the plurality of nozzles;

a workpiece chamber having a shroud that envelopes the plurality of nozzles, the workpiece chamber comprising:

a first opening in the shroud;

a second opening in the shroud, opposite the first opening, such that the elongated curved workpiece may extend out of the shroud through the first opening and the second opening; and the workpiece chamber is configured for movement along the elongated curved workpiece such that different portions of the elongated curved workpiece sequentially receive shot on a plurality of sides without repositioning of the elongated curved workpiece; and a workpiece holder disposed in the first opening, the workpiece holder comprising a U-shaped three-sided bracket supporting a first guide on a first side, a second guide on a second side opposite the first side, and a ball transfer unit on a third side perpendicular to the first side and the second side, wherein the first guide, the second guide, and the ball transfer unit are adapted to guide the workpiece through the first opening for maintaining a predetermined orientation between the workpiece and the plurality of nozzles to provide conformity during shot-peen forming along the different portions of the elongated curved workpiece.

20. The omnidirectional shot peening delivery system of claim 19, comprising a threaded bolt configured to secure the first guide to the U-shaped three-sided bracket, wherein the threaded bolt enables a position of the first guide to be adjusted for accommodating differently sized workpieces.

* * * * *